US005086701A

United States Patent [19]

Gasparrini et al.

[11] Patent Number: 5,086,701

[45] Date of Patent: * Feb. 11, 1992

[54] PRINTING PRESS BLANKET CLEANER

[75] Inventors: Charles R. Gasparrini, Rye, N.Y.; Carl Arnolds, Stamford, Conn.

[73] Assignee: Baldwin Technology Corp., Stamford, Conn.

[ * ] Notice: The portion of the term of this patent subsequent to Nov. 27, 2007 has been disclaimed.

[21] Appl. No.: 272,635

[22] Filed: Nov. 17, 1988

[51] Int. Cl.[5] ..... B41F 35/02

[52] U.S. Cl. ..... 101/425; 101/423

[58] Field of Search ..... 101/423, 425, 424

[56] References Cited

U.S. PATENT DOCUMENTS

| | | | |
|---|---|---|---|
| 504,465 | 9/1893 | Beater | 101/167 |
| 1,114,893 | 10/1914 | Lerche | 101/216 |
| 1,378,278 | 5/1921 | Roberts | 101/425 |
| 3,049,997 | 8/1962 | Grembecki et al. | 101/425 |
| 3,309,993 | 3/1967 | Grembecki et al. | 101/425 |
| 3,835,779 | 9/1974 | Ross et al. | 101/425 |
| 4,015,307 | 4/1977 | Kossak | 101/425 |
| 4,090,445 | 5/1978 | Sassi | 101/425 |
| 4,304,026 | 12/1981 | Borostyan | 15/308 |
| 4,389,936 | 6/1983 | Jaffa et al. | 101/123 |
| 4,393,778 | 7/1983 | Kaneko | 101/425 |
| 4,667,597 | 5/1987 | Wright et al. | 101/423 |
| 4,704,963 | 11/1987 | Nishimura et al. | 101/423 |
| 4,747,348 | 5/1988 | Jeschke et al. | 101/425 |
| 4,841,862 | 6/1989 | Seefried | 101/423 |
| 4,875,412 | 10/1989 | Wright et al. | 101/423 |

FOREIGN PATENT DOCUMENTS

| | | | |
|---|---|---|---|
| 1234430 | 2/1967 | Fed. Rep. of Germany | 101/425 |
| 3601539 | 7/1986 | Fed. Rep. of Germany . | |
| 2117385 | 6/1972 | France . | |
| 55-55871 | 4/1980 | Japan . | |
| 127178 | 5/1973 | Norway . | |
| 127179 | 5/1973 | Norway . | |

OTHER PUBLICATIONS

Xerox Technical Disclosure Bulletin, "Pinchoff Helical Brush Cleaner", Peter M. Tolliver, vol. 1, No. 8, Aug. 1976, p. 69.

IBM Technical Disclosure Bulletin, "Xerographic Cleaning Station", J. K. Richert and E. C. Van Wert, vol. 25, No. 1, Jun. 1982, pp. 255-256.

Xerox Technical Disclosure Statement, "A Cleaning System", R. E. Hewitt, vol. 3, No. 4, Jul./Aug. 1978, pp. 253-254.

IBM Technical Disclosure Bulletin, "Cleaner to Developer Toner Recirculation", J. F. Eich and B. T. Witte, vol. 21, No. 5, Oct. 1978, pp. 1784-1785.

*Primary Examiner*—David A. Wiecking
*Assistant Examiner*—Joseph R. Keating
*Attorney, Agent, or Firm*—Morgan & Finnegan

[57] ABSTRACT

A vacuum blanket cleaning system is provided for removing dust, lint or ink from a blanket cylinder in an offset printing press during the uninterrupted course of a press run. Operation is effected by an air cylinder which periodically urges a cleaner against the blanket cylinder and retracts the cleaner from the blanket cylinder for replacement or maintenance. The action of the cleaner in combination with rotation of the blanket cylinder is such as to loosen dust and lint from the blanket cylinder, which dust and lint is then drawn into a vacuum system that surrounds the cleaner.

10 Claims, 5 Drawing Sheets

PRINTING PRESS BLANKET CLEANER

BACKGROUND OF THE INVENTION

This invention relates to cleaning apparatus for printing presses and, in particular, to a dry vacuum apparatus for cleaning a blanket cylinder in an offset printing press without interrupting or slowing the operation of the press.

Offset printing, in comparison with the letterpress method of printing, has become the predominant printing method in the newspaper publishing industry. This is due in part to the increased sharpness of the printed images and the ability to print on less even surfaces than are required by the letterpress method. Also, another important factor in the popularity of offset printing is the lower cost of the printing plates used with offset presses.

Offset printing presses typically employ a blanket cylinder, that is to say, a rubber cylinder or a rubber-covered cylinder, for the purposes of receiving inked images from a printing plate. The inked images are then offset onto paper passed between the blanket cylinders or an impression cylinder. Continuous printing is made possible by wrapping a printing plate or a plurality of printing plates around the surface of a plate cylinder designed for rotation in contact with the blanket cylinder.

In operating blanket-to-blanket presses, a web of paper passes between two blanket cylinders mounted such that one blanket cylinder serves as an impression cylinder for the other, resulting in simultaneous printing on both sides of the web of paper.

Continuous offset printing is adversely affected by dust and lint from the web of paper which tend to accumulate on the blanket cylinder(s). This dust and lint reduces the quality of the printed product. The accumulation of dust, lint or ink on a blanket cylinder thus presents a serious annoyance and necessitates undesirable down-time for cleaning. The problem is especially acute in the newspaper industry, when, in response to the rising cost of newsprint stock, less expensive grades of paper having higher lint content often are substituted for more expensive grades.

Previously known vacuum devices for cleaning blanket cylinders involved wet vacuum systems for removing debris. In these systems, segments of the blanket cylinder are continually immersed and cleaned with a solvent. The excess solvent is then removed by a wiper with a vacuum header adjacent the wiper blade. See, for example, U.S. Pat. No. 3,835,779 to Ross et al. The present invention avoids the need for solvents by employing a completely dry system for removing debris and, unlike previous dry systems, no lint catcher is needed or used.

Additionally, the present invention employs a separate vacuum means unlike the IBM Technical Disclosure Bulletin, "Cleaner to Developer Toner Recirculation", Eide and Witte, Vol. 21, No. 5, October, 1987, pp 359–360 that discloses only a slight vacuum caused by the rotation of the brush.

Lastly, this invention uses the seals to increase the effectiveness of the vacuum means, unlike the Xerox Disclosure Journal, "Flexible Cleaner Seal", McCarroll, Vol. 8, No. 5 September/October 1983, p. 431 which discloses a flexible seal to prevent dirt from escaping into other machine parts.

OBJECTS AND STATEMENT OF THE INVENTION

It is, therefore, an object of the present invention to provide apparatus for cleaning a blanket cylinder during the course of a press run without interrupting press operation or causing waste during the run. This permits a sharper reproduction for a printed product and incurs less down-time. It also permits the use of grades of paper stock having higher lint contents.

Another object of the present invention is to provide apparatus suitable for integral construction with an offset press, or for manufacture as an add-on device capable of being retrofitted to an existing press.

A further object of this invention is to provide an improved vacuum cleaner adapted for automatic operation at a frequency of engagement adjustable by a press operator.

Another object of this invention is to provide an improved vacuum blanket cleaner which will not abrade the blanket cylinder.

Another object of this invention is to provide an improved vacuum blanket cleaner which promotes longer blanket life.

Yet another object of this invention is to provide an improved vacuum cleaner which may be operated without causing waste of materials.

Still another object of this invention is to provide an improved vacuum blanket cleaner which operates to provide a longer plate life.

In accordance with this invention, generally stated, apparatus for cleaning a blanket cylinder of an offset printing press during operation of the press are provided, having a cleaning means which is periodically urged against the blanket cylinder by the motion of a pivoting arm connecting the cleaning means with an air cylinder. The action of the cleaning means in combination with rotation of the blanket cylinder is such as to loosen dust and lint from the blanket cylinder. The dust and lint is then drawn into a vacuum system which includes a housing that surrounds the cleaning means.

The frequency of the automatic engagement and operation of the blanket cleaner of this invention is adjustable by a press operator in response to various anticipated or observed operating parameters such as the length of the press run and the lint content of the paper stock. The invention may also include means in the housing adapted to engage the blanket cylinder and serves the dual functional of loosening dirt and lint and sealing the vacuum system.

The foregoing and other objects, features and advantages of the present invention will be apparent to those skilled in the art in light of the following description of preferred embodiments in connection with the accompanying drawings.

DESCRIPTION OF PREFERRED EMBODIMENTS

Figure 1:
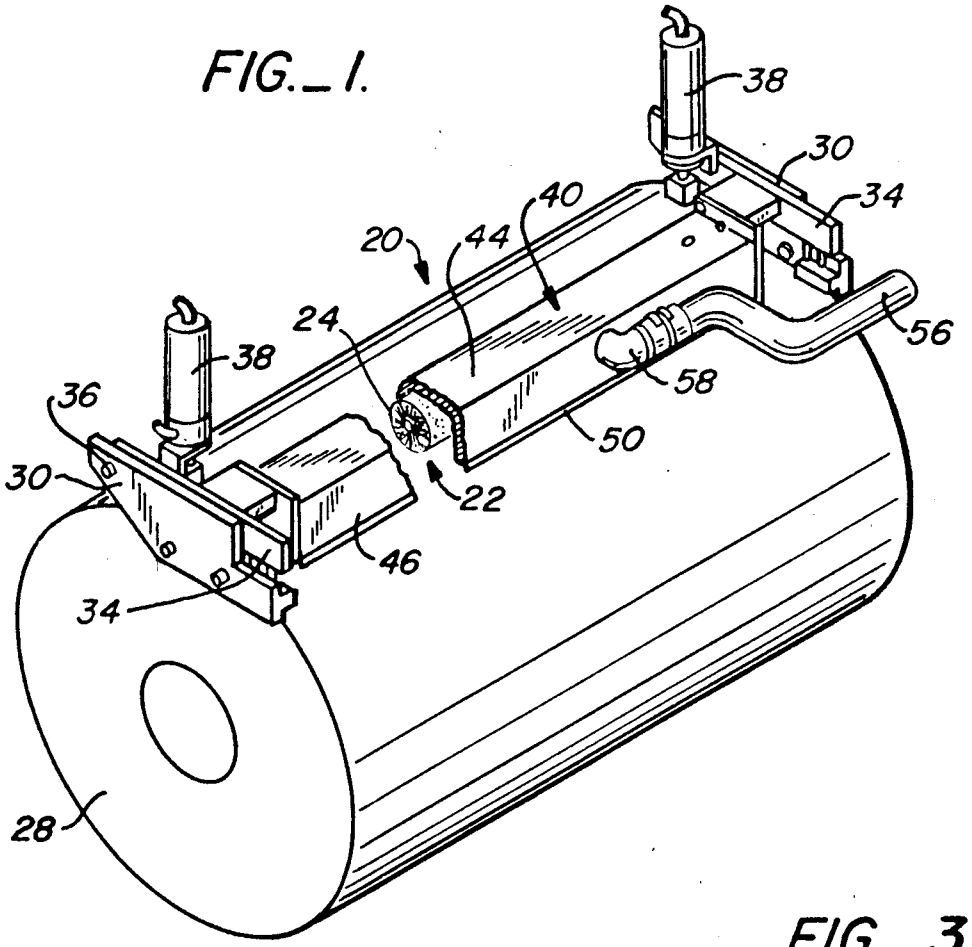
FIG. 1 is a side perspective view, in partial cross-section, of a vacuum blanket cleaner system constructed in accordance with one embodiment of the present invention.

Referring now to the drawings, and, in particular, to FIG. 1, there is shown a dry blanket cleaner in accordance with one embodiment of the present invention. The blanket cleaner, shown generally at 20, includes a brush assembly 22 made up of at least one cylindrical brush 24 and a vacuum means (not shown).

The blanket cleaner in accordance with this embodiment of the present invention is mounted in operative association with a blanket cylinder 28, generally parallel to a longitudinal axis of the blanket cylinder. Blanket cleaner mounting brackets 30 are attached to the press frame (not shown) generally outside either end of blanket cylinder 28. Pivoting arms 34 connect the blanket cleaner 20 with mounting brackets 30. These pivoting arms 34 serve to carry the blanket cleaner 20 and are pivotal about pin 36.

The blanket cleaner is generally pivotal between two operative positions. Pivoting of said arms 34 between these positions is affected by a plurality of actuators 38 attached to pivot arms 34. Preferably, the actuator employed is a pneumatic actuator, although electrical or hydraulic actuators can be used if desired. Conventionally, compressed air is used because it is commonly is available in the press rooms, while fluid sources are not. In the first operative position, (FIG. 3) blanket cleaner 20 is biased away from blanket cylinder 28 to facilitate, for example, replacement of the brushes, repair or maintenance of the machine and/or changing of the web and blankets.

In the second operative position, (FIG. 2) the blanket cleaner 20 is held in contact with the surface of the blanket cylinder 28. In this second position, the blanket cleaner can affect cleaning and removal of the lint and debris from the blanket cylinder.

Figure 4:
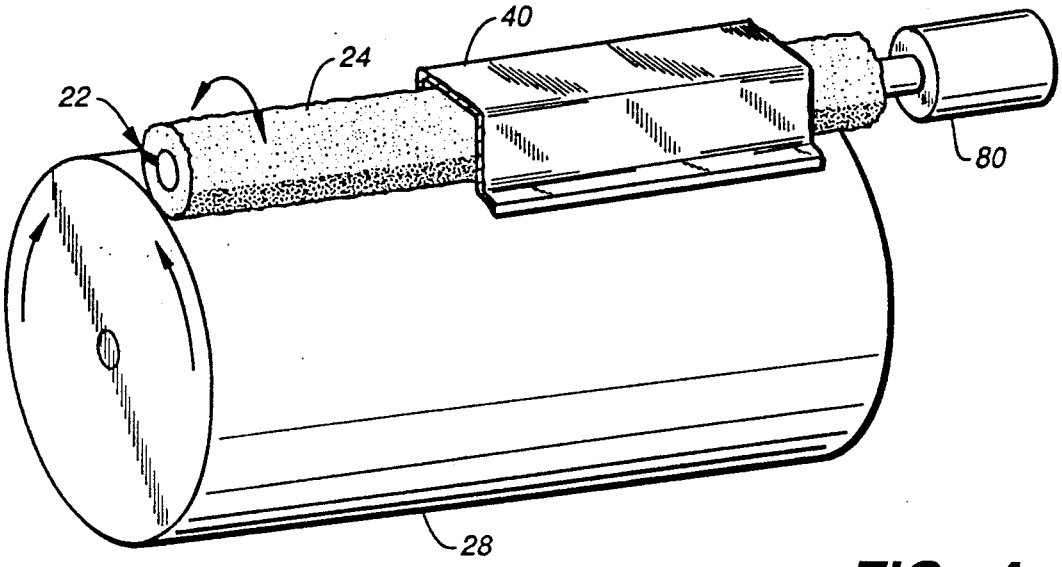
FIG. 4 is a side perspective view, in partial cross-section, of a vacuum blanket cleaner system constructed with a cylindrical brush.

The vacuum portion of one embodiment of blanket cleaner 20 is generally comprised of substantially U-shaped housing 40 extending along the length of the blanket cylinder and cylindrical brush 24. The cylindrical brush 24 is mounted inside housing 40 which in turn is mounted to pivot arms 34. The cylindrical brush 24 is rotatable in either direction by a motor 80 (FIG. 4). The speed of rotation ranges from zero rpm to a maximum rmp. The maximum rpm will provide a tangential brush speed in excess of that of the blanket. The motor 80 additionally can cause the cylindrical brush 24 to oscillate.

Figure 5:
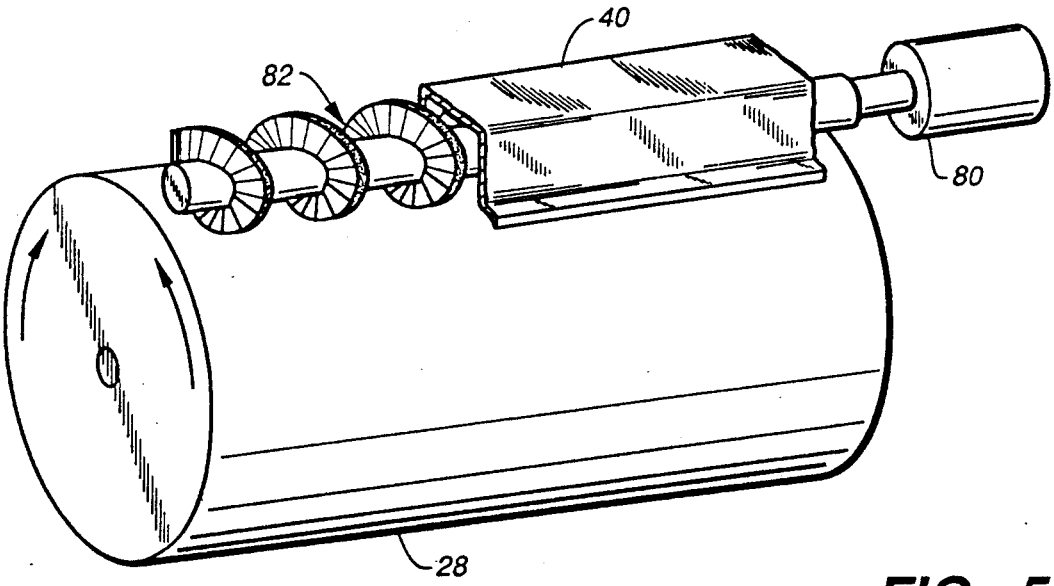
FIG. 5 is a side perspective view, in partial cross-section, of a vacuum blanket cleaner system constructed with a spiral brush.

In the embodiment shown in FIG. 5, a spiral brush 82 is mounted inside housing 40 which in turn is mounted to pivot arms 34. The spiral brush 82 is rotatable in either direction by a motor 80. The speed of rotation and oscillation of spiral brush 82 is the same as the latter embodiment. Additionally, oscillation may be omitted since the spiral brush provides the equivalent of oscillatory motion.

Figure 6:
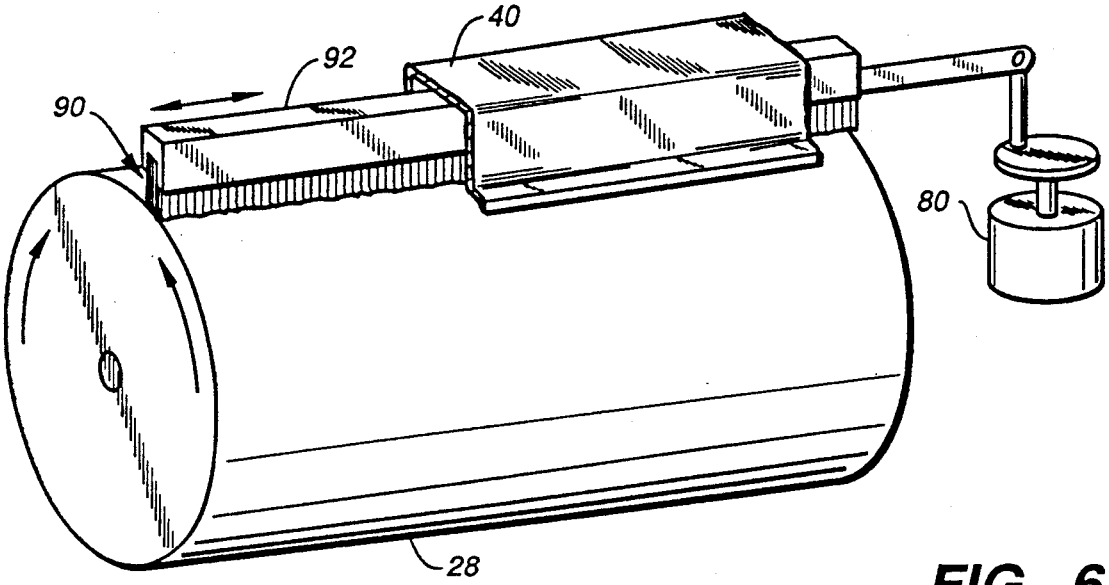
FIG. 6 is a side perspective view, in partial cross section, of a vacuum blanket cleaner system constructed with a brush assembly and oscillating motor.

In the embodiment shown in FIG. 6, the brush assembly 22 is mounted inside housing 40 which in turn is mounted to pivot arms 34. The housing 40 includes brushes 90 retained the brush holder 92, which brush holder is removably mounted to the housing 40 in any convenient manner and can be easily replaced as required. The brush holder 92 is segmented to allow individual sections to be lifted so as not to contact the blanket cylinder during clearing. Segmenting can be desirable since newspaper blanket cylinders are generally set up in quarters or pages; i.e., a web can be double width (full blanket) or single width (half blanket). Segmenting the brushes, preferably into four sections, permits the brushes in the unused area to be lifted away. The brush assembly 22 is oscillated by motor 80.

A variety of materials can be used for the cylindrical brush 24, spiral brush 82 or brushes 90, provided that they do not damage the surface of the blanket cylinder 28. These materials include both natural and synthetic fibers as well as thin metal bristles.

Figure 7:
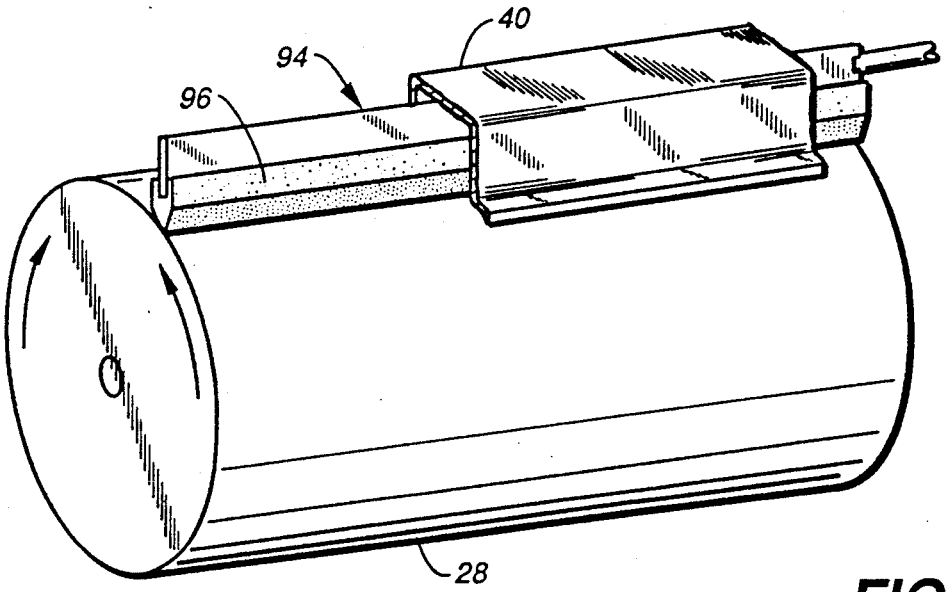
FIG. 7 is a side perspective view, in cross-section, of a vacuum blanket cleaner system constructed with a doctor blade.

In the embodiment shown in FIG. 7, the doctor blade 94 is enclosed inside housing 40. The doctor blade 94 has a rubber tip 96. The doctor blade can be engaged with or without oscillating motion imparted by optional motor 80.

Figure 8:
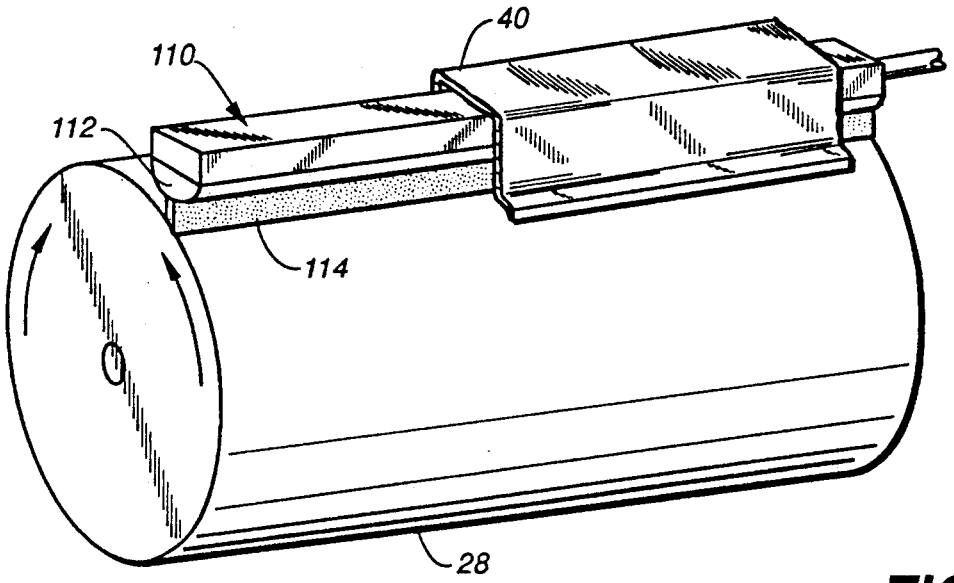
FIG. 8 is a side perspective view, in partial cross-section, of a vacuum blanket cleaner system constructed with an inflatable pressure pad.

In the embodiment shown in FIG. 8, the inflatable pressure pad 110 is enclosed inside housing 40. The inflatable pressure pad 110 includes an inflatable rubber pad 112 and scrapping tip or bead 114 which can be made of rubber. The inflatable pressure pad can be engaged by air pressure with or without oscillating motion imparted by optional motor 80.

Figure 9:
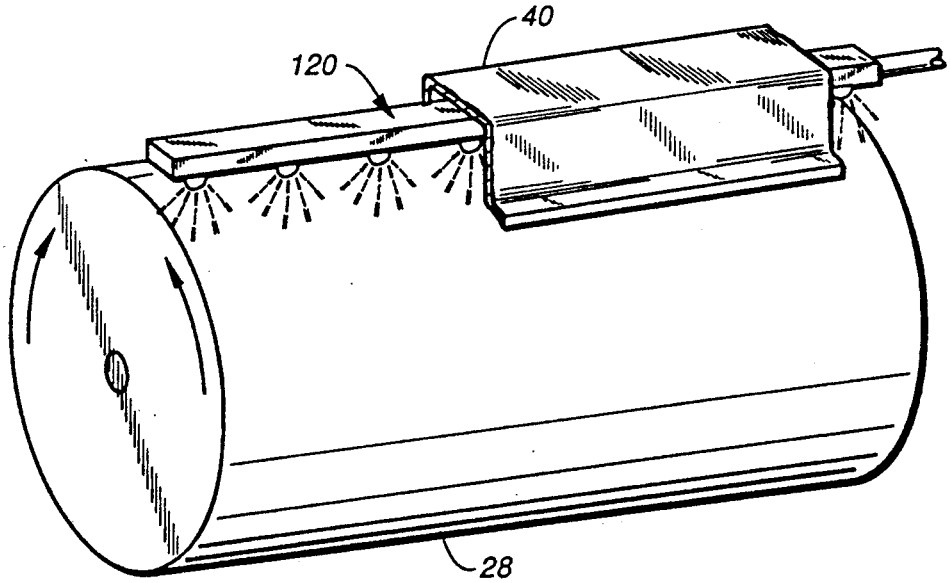
FIG. 9 is a side perspective view, in partial cross-section, of a vacuum blanket cleaner system constructed with an air or ultrasound spray bar.

In the embodiment shown in FIG. 9, an air or ultrasound spray bar 120 is enclosed inside housing 40. The air or ultrasound spray bar can be engaged with or without oscillation imparted by optional motor 80.

Figure 10:
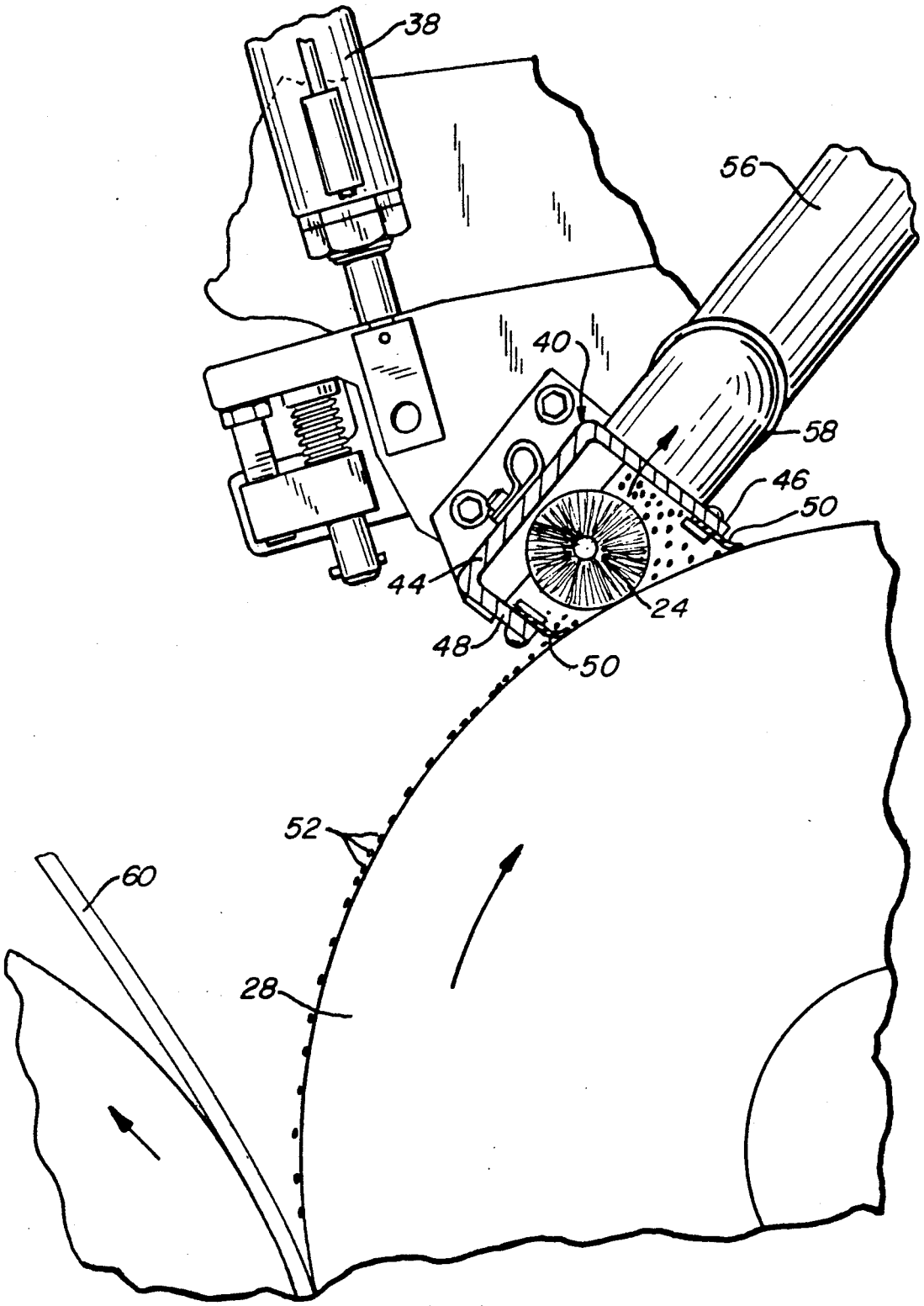
FIG. 10 is an enlarged side view, in cross-section, of the vacuum blanket cleaner system constructed in accordance with one embodiment of the present invention.

Housing 40, (FIG. 10) in the form of an inverted U-shaped channel, has a top surface 44 and parallel sides, 46 and 48 respectively. Housing 40 is mounted between pivot arms 34 in a downward position with the open end facing the blanket cylinder 28. Alternatively, U-shaped channel 40 may be mounted forward or back relative to the centerline of the blanket cylinder 28 as desired. For example, FIG. 4, shows an embodiment wherein the brushes are mounted forward of the centerline of the blanket cylinder.

Flexible wipers 50 (FIG. 10) are positioned at the ends of sides 46 and 48 of housing 40 and serve to contact the surface of blanket cylinder 28 to provide sealing surfaces in contact with the blanket roller when the blanket cleaner is engaged. These wipers 50 also serve a secondary purpose of loosening and dislodging lint and debris 52 from the surface of the blanket cylinder 28.

Loosened lint and debris 52 are removed from the interior of housing 40 by means of an appropriate vacuum system. A vacuum generating machine (not shown) is connected to vacuum port 58 in housing 40 by hose 56. Lint and debris 52 are conveyed through hose 56 by means of the vacuum to be deposited in an appropriate disposal unit (not shown).

Referring now to FIGS. 1, 2, 3 and 10 there is shown the general operation of the blanket cleaner in accordance with a blanket to blanket press embodiment of the present invention. A web of imprinting material 60 passes between counterrotating blanket cylinders 28 and is imprinted on both front and rear sides of the web. In the course of this imprinting operation, lint and debris 52 from the web 60 accumulate on the surface of the blanket cylinders 28 and, if allowed to remain thereon, tend to reduce to overall quality of the printed product.

In order to remove this lint and debris from the surface of the blanket cylinders 28, blanket cleaners 20, generally located atop the blanket cylinders 28, are biased against the cylinders by biasing means in the form of actuators 38. Generally, it is not necessary that the blanket cleaners 20 be continuously in contact with blanket cylinders 28 throughout the imprinting operation, however, where an excessive amount of lint and debris accumulate rather quickly, it may be desirable to leave them engaged during operation of the press. Under normal operating condition the blanket cleaners 20 are periodically actuated against the blanket cylinders for a predetermined time to effect cleaning of the surface.

Figure 2:
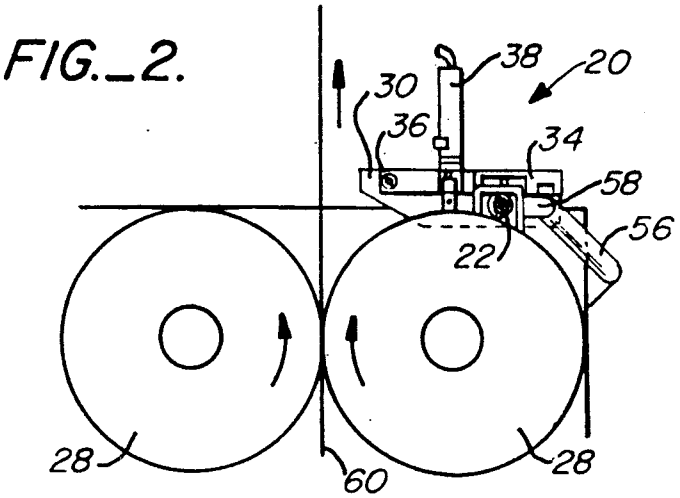
FIG. 2 is a side view of the vacuum blanket cleaner system in the engaged position.
Figure 3:
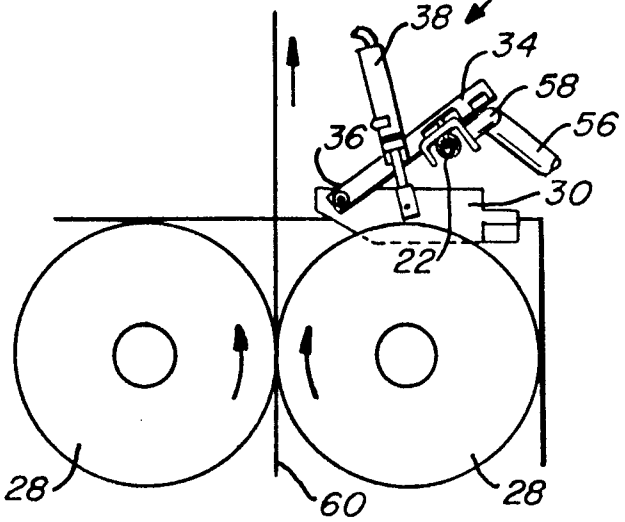
FIG. 3 is a side view of the vacuum blanket cleaner system in the disengaged position.

Periodic operation of the blanket cleaner of this invention may be controlled by conventional timing mechanisms related either to rotation of the presses or on command of the operator. In any case, the operation of the actuator is controlled so that when blanket cleaning is desired, the actuator 38 is operated so that the cleaner is moved from the disengaged position (FIG. 3) to the engaged position (FIG. 2). In the engaged position the rotating cylindrical brush 24 of the brush assembly 22 is brought into contact with the surface of blanket cylinder 28. The rotating cylindrical brush 24 are utilized to wipe the blanket cylinder 28, and after a predetermined period of time, the actuator 38 is operated to cause the brush assembly 22 to disengage as shown in FIG. 3.

While engaged, lint and debris that is loosened and dislodged by the brushes 24, and to some degree, by the wipers is drawn off and disposed of by the vacuum system. This effectively removes the lint and debris from the blanket cylinder during the imprinting operation.

The particular embodiment just described is preferred because of the ease of installation and adjustment provided by the construction described. For example, the various working parts are located physically above the blanket cylinder 28, and thus are readily accessible both for installation and maintenance. Other locations are compatible with the broader aspect of our invention. However, it is clear by utilizing the brush assembly 22 in conjunction with the vacuum means 56, the need for the lint catcher assembly used in the prior art is obviated.

Numerous variations, within the scope of the appended claims, will be apparent to those skilled in the art in light of the foregoing description and accompanying drawings. As indicated, other fluid operating sources or other timing mechanisms may be employed to alter the operation of the actuators disclosed. The sequence of the operating mechanism may be changed, if desired.

What is claimed is:

1. A dry mechanical cleaning system for removing dirt and lint from a blanket cylinder of an offset printing press having at least one blanket cylinder, said cleaning system comprising:

(a) a blanket cleaner mounting frame attached to a press frame adjacent the blanket cylinder;

(b) arm means movably connecting said mounting frame and said press frame;

(c) brush housing means attached to said movable arm means and adapted to extend along the length of the blanket cylinder;

(d) said housing means being adapted to enclose a portion of the surface of said blanket cylinder;

(e) means for moving said arm means to and from a first position away from said blanket cylinder and to and from a second position adjacent said blanket cylinder;

(f) rotatable brush means mounted within and enclosed by said housing means and adapted to engage said blanket cylinder when said rotatable brush means is in said second position;

(g) means for rotating said rotatable brush means;

(h) vacuum flow means in cooperative relationship with said housing to establish a flow path within said housing at predetermined times whereby said brush means will loosen dirt and lint without the use of liquid from said rotating blanket cylinder permitting said vacuum flow means and housing to remove such dirt and lint; and (i) said housing means includes sealing means extending from said housing into contact with said blanket cylinder to provide a sealing surface between said blanket cylinder and said housing when said cleaner is in said second position adjacent said blanket cylinder.

2. A dry mechanical system as defined in claim 1 wherein said rotatable brush means is a cylindrical shaped brush.

3. A dry mechanical system as defined in claim 2 wherein said means for rotating said cylindrical brush includes means for oscillating said cylindrical brush.

4. A dry mechanical system as defined in claim 1 wherein said rotatable brush means is a spiral shaped brush.

5. A dry mechanical system as defined in claim 4 wherein said means for rotating said spiral brush includes means for oscillating said spiral brush.

6. In an offset printing press having a blanket cylinder, the improvement which comprises a dry mechanical cleaning system for removing dirt and lint from the blanket cylinder during an uninterrupted course of a press run, said blanket cleaning system including a rotating brush means operatively mounted to said press, said rotating brush means including at least one rotating brush mounted for movement between at least a first position where said brush is in contact with said blanket cylinder and a second position where said brush is remote from said blanket cylinder, means for rotating said brush means, means for moving said brush between said first and said second position, enclosure means surrounding said rotating brush means and enclosing a portion of the blanket cylinder when said rotating brush means is in contact with said blanket cylinder; means for mounting said enclosure means to said press includes means for adjusting the position of said enclosure means with respect to said blanket cylinder; and vacuum flow means communicating with said enclosure means and establishing a flow path within said enclosure means for removing dislodged debris without the use of liquid from said blanket cylinder; sealing means depending from said enclosure means and engaging said blanket cylinder when said rotating brush means is in contact with said blanket cylinder for substantially sealing off the flow path within said enclosure means.

7. The improvement of claim 6 wherein said rotatable brush means is a cylindrical shaped brush.

8. The improvement of claim 7 wherein said means for rotating cylindrical brush includes means for oscillating said cylindrical brush.

9. The improvement of claim 6 wherein said rotatable brush is a spiral shaped brush.

10. The improvement of claim 9 wherein said means for rotating said spiral brush includes means for oscillating said spiral brush.

* * * * *